US005136859A

United States Patent [19]

Nitta

[11] Patent Number: 5,136,859

[45] Date of Patent: Aug. 11, 1992

[54] APPARATUS AND METHOD FOR WINDING AND DOFFING ROLL OF KNITTED CLOTH IN CIRCULAR KNITTING MACHINES

[75] Inventor: Yoshinobu Nitta, Osaka, Japan

[73] Assignee: Precision Fukuhara Works, Ltd., Hyogo, Japan

[21] Appl. No.: 698,812

[22] Filed: May 13, 1991

[51] Int. Cl.[5] ..... D04B 15/88

[52] U.S. Cl. ..... 66/151; 139/1 R; 242/58.6; 414/911

[58] Field of Search ..... 66/151, 152, 147, 148, 66/149 R, 153, 150; 242/63, 62, 58.6, 79, 55, 55.17, 58.2, 64; 139/1 R; 414/280, 417, 910, 911

[56] References Cited

U.S. PATENT DOCUMENTS

| | | | |
|---|---|---|---|
| 485,225 | 11/1892 | Priest | 242/79 |
| 935,495 | 9/1909 | Griffin | 242/58.6 |
| 3,839,885 | 10/1974 | Bourgeois | 66/151 |
| 3,872,692 | 3/1975 | Miyagawa et al. | 66/151 |
| 3,985,001 | 10/1976 | Eschenbach | 66/149 R |
| 4,079,600 | 3/1978 | Amaya et al. | 66/56 |
| 4,441,662 | 4/1984 | Seragnoli | 242/58 |
| 4,693,433 | 9/1987 | Martin | 242/58.6 |
| 4,706,905 | 11/1987 | Torres | 242/68.4 |
| 4,888,963 | 12/1989 | Scherzinger et al. | 66/151 |
| 5,042,272 | 8/1991 | Farr | 66/151 |

*Primary Examiner*—Werner H. Schroeder
*Assistant Examiner*—Larry D. Worrell
*Attorney, Agent, or Firm*—Bell, Seltzer, Park & Gibson

[57] ABSTRACT

An automated apparatus and method for winding and doffing a roll of knitted cloth from a circular knitting machine is disclosed. The apparatus includes a winding roller for winding knitted cloth produced on the knitting machine. A universal joint pivotably connects one end of the winding roller to one support arm. The other end of the winding roller is removably supported by an opposing support arm. After a roll of knitted cloth is wound, the other end of the winding roller is moved to an unloading, doffing position by swinging the free end of the winding roller using the universal joint as a fulcrum. At this position, the roll of knitted cloth is inclined downwardly and one end is placed on a receiver tray. The cloth roll is then pushed from the winding roller onto the receiver tray. The receiver tray is moved and the other end of the winding roller is moved back to the home position.

7 Claims, 3 Drawing Sheets

Fig. 1.
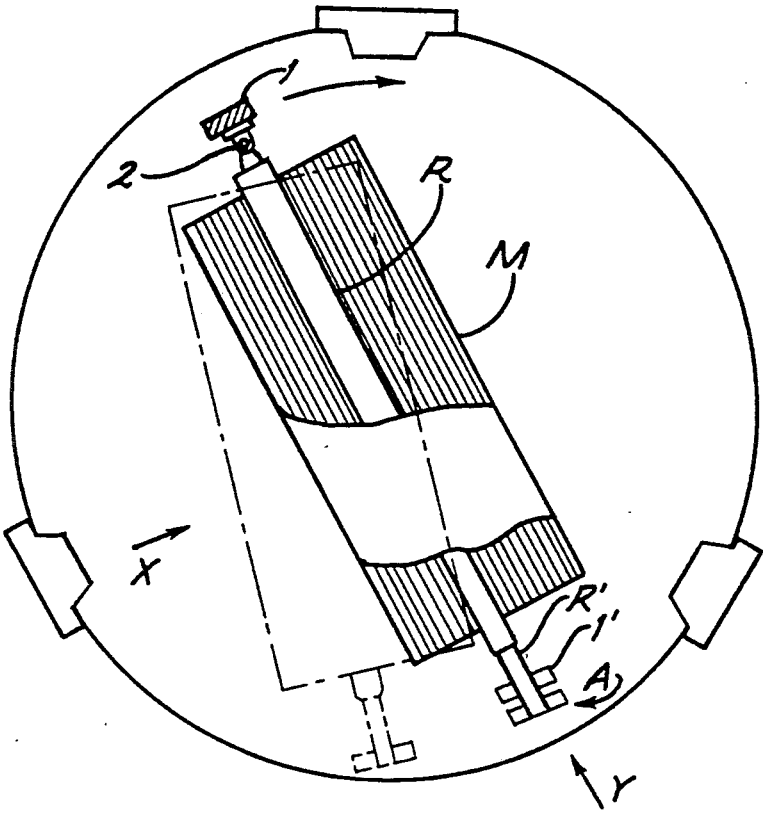
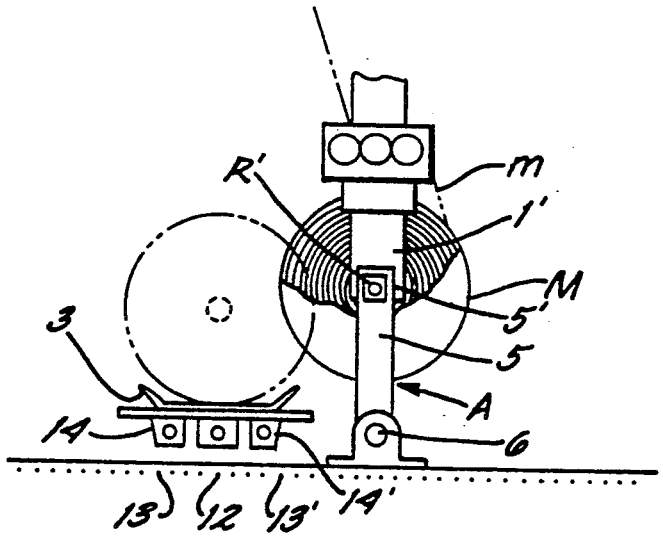
Fig. 2.

Fig. 3.
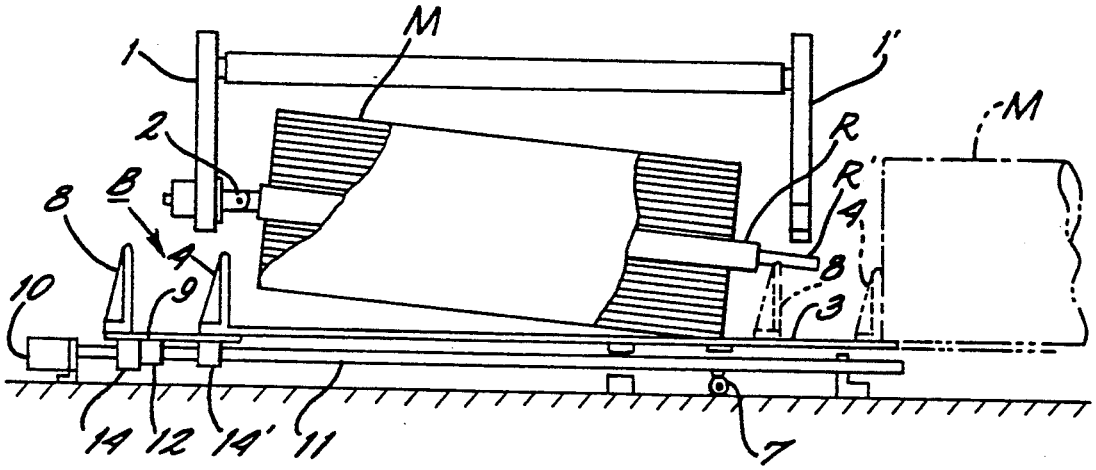
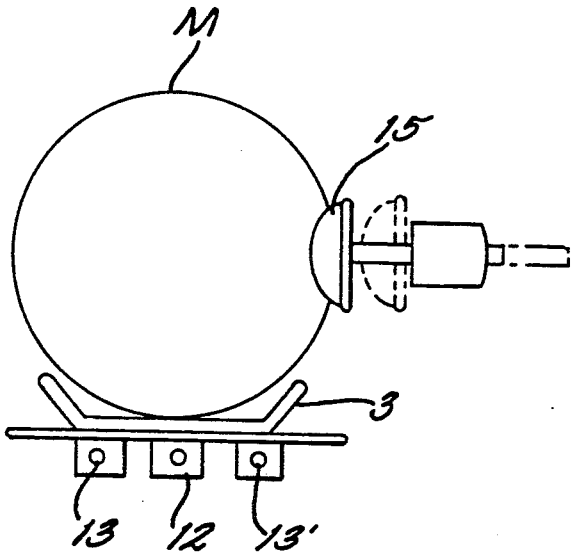
Fig. 5.

APPARATUS AND METHOD FOR WINDING AND DOFFING ROLL OF KNITTED CLOTH IN CIRCULAR KNITTING MACHINES

FIELD OF THE INVENTION

The present invention relates to an apparatus and method for winding and doffing a roll of knitted cloth from a circular knitting machine.

BACKGROUND OF THE INVENTION

In a conventional circular knitting machine, the knitted cloth is flattened and wound on a winding roller supported by a winding apparatus. When a full roll of knitted cloth has been wound, the winding roller and knitted cloth is removed from the opposed support arms of the winding apparatus. A new winding roller then is mounted on the opposed support arms of the winding apparatus for use in the next cloth winding process.

For increasing efficiency when changing the winding rollers, a winding apparatus having an automated mechanism for changing the winding rollers has been proposed. However, the apparatus is complicated in structure and also requires a multiple number of winding rollers, thus resulting in increased initial investment. In another proposed winding apparatus, two halves of a split winding roller are removed after the knitted cloth has been wound. In this apparatus, the winding roller is split in the center, and each half is pulled right or left. However, the apparatus requires a large installation space, thus reducing the number of adjacent knitting machines which can be positioned in a given space. The winding rollers must be pulled out of the rolled knitted cloth from opposing left and right sides. As a result, in existing knitting mills, the position of the machines must be readjusted and spaced farther from each other.

SUMMARY OF THE INVENTION

With the foregoing in mind, the present invention provides an apparatus and method for winding and doffing a roll of knitted cloth on a single winding roller without changing the installed positions of existing knitting machines, thereby improving efficiency and operation of the knitting process.

The apparatus of the present invention solves the above-mentioned problems of the prior art and does not require multiple winding rollers or repositioning of knitting machines in an existing knitting mill. A winding roller is supported at both ends on opposed support arms for winding knitted cloth thereon. A universal joint connects one end of the winding roller to one of the support arms and the other end of the winding roller is removably supported on the other of the support arms. Transfer means, in the form of a vertical leg member, engages and pivotably transfers the other end of the roll of knitted cloth to an unloading, doffing position and back to a home, winding position by swinging the other end of the winding roller using the universal joint as a fulcrum. A receiver tray is dimensioned for receiving the roll of knitted cloth and is positioned adjacent the support arms for engaging the roll of knitted cloth when the roll is moved into the doffing position. A pushing plate is associated with the received tray and engages the end of the roll of knitted cloth for pushing the cloth roll from the winding roller.

In accordance with the present invention, the disclosed method of winding and doffing a roll of knitted cloth in a circular knitting machine includes the steps of winding the knitted cloth around a winding roller having one end pivotably connected by a universal joint to one support arm. The winding roller is stopped at a predetermined position, and the roll of knitted cloth is cut to separate it from the descending knitted cloth. The other end of the winding roll is transferred to an unloading position on a receiver tray by swinging the winding roller using the universal joint at one end of the winding roller as a fulcrum. The roll of knitted cloth is pushed off the winding roller and onto the receiver tray. The other end of the emptied winding roller then is returned to its home position.

In a preferred embodiment for the method of the invention the other end of the winding roller is disengaged from the support arm. The roll of knitted cloth is placed on the receiver tray at the unloading, doffing position and in an inclined position. A pushing plate member pushes on one end of the roll of knitted cloth in a horizontal sliding motion, and the roll of knitted cloth is pushed from the winding roller. The winding roller is then returned to its home or starting position.

BRIEF DESCRIPTION OF THE DRAWINGS

A preferred embodiment of a winding and doffing apparatus in a circular knitting machine according to the present invention will now be described with reference to the accompanying drawings in which:

FIG. 1 is a fragmentary plan view of the winding and doffing apparatus in accordance with the present invention;

FIG. 2 is a fragmentary side elevation view of the winding and doffing apparatus taken in the direction of arrow Y in FIG. 1;

FIG. 3 is an elevation view of the winding and doffing apparatus taken in the direction of the arrow X in FIG. 1 and showing the position of the receiver tray;

FIG. 5 is an elevational view of a cloth roll pushing member.

DETAILED DESCRIPTION OF THE INVENTION

Figure 4A:
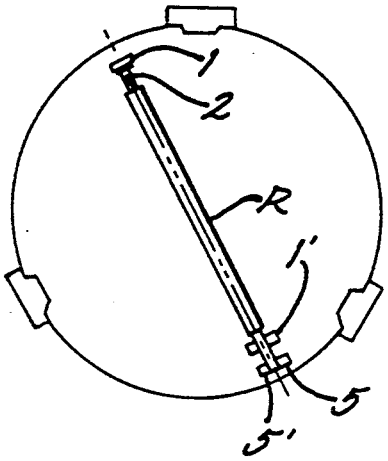
FIGS. 4A–4D illustrate the successive steps of the winding and doffing processes.

Referring to FIGS. 1 through 3, there is disclosed the winding and doffing apparatus in accordance with the present invention. A tapered winding roller, indicated at R, is supported at opposed ends on opposed support arms 1, 1'. The diameter of the winding roller R decreases toward the end associated with the support arm 1', which has a stub shaft R' of reduced diameter formed thereon. The larger diameter end portion of the winding roller R is coupled to the lower end of the support arm 1 by a conventional universal joint 2. The other smaller diameter stub shaft end portion R' is removably supported in a notched section formed on the lower end of the support arm 1'. When both winding roller ends are supported on the support arms 1, 1', the winding roller R is oriented in a winding position so that the knitted cloth is flattened and wound onto the winding roller R. The winding roller R is rotated by a conventional drive mechanism (not shown) common to circular knitting machines. The winding roller R and the support arms 1, 1' rotate in the direction shown in the arrow of FIG. 1 and the knitted cloth forms the roll M of knitted cloth.

Means for transferring the roll of knitted cloth M to an unloading, doffing position is indicated generally at A, and includes a vertical leg member 5 having upper and lower ends (FIG. 2). The lower end of the leg member 5 is pivotally supported, as indicated at 6, on a floor bracket. The upper end of the leg 5 includes support means 5, for engaging and disengaging the stub shaft R' of the winding roller R from the leg 5. Means (not shown) may be provided for engaging the leg 5 for pivoting and swinging the leg 5 in a counterclockwise direction.

In FIG. 3, means for unloading the rolled knitted cloth M from the winding roller R is indicated generally at B and includes an elongate receiver tray 3 on which one end of the roll of knitted cloth M is placed in an inclined position when transferred to the unloading, doffing position. Rollers 7 are positioned under the receiver tray 3 for allowing the receiver tray 3 to roll on the floor. A cloth roll pushing plate member 4 is fixed to and extends upwardly from the rear position of the receiver tray 3 and is adapted to engage the end of the roll of knitted cloth M for pushing the same longitudinally from the winding roller R, as illustrated in dash-dot lines in FIG. 3.

An upstanding winding roller receiver member 8 is fixed at its lower end on the rear of a plate 9. The forward end of the plate 9 is fixed on the bottom of the pushing plate member 4. The upper end of the winding roller receiver member 8 temporarily receives and supports the smaller diameter stub shaft portion R' of the winding roller R, as shown in dotted lines in FIG. 3, when the knitted cloth roll M is removed from the winding roller R. A threaded shaft 11 is positioned below the plate 9 and includes a nut 12 operatively connected to the receiver tray 3. The nut 12 is moveable along the threaded shaft 11 when the shaft is rotated. A reversible motor 10 is connected to the shaft 11 for rotating the shaft in forward or reverse directions. As the threaded shaft 11 is rotated, the nut 12, engaging the receiver tray 3, is longitudinally moved along the shaft 11, thus imparting reciprocative, sliding movement to the receiver tray 3. Guide rods 13, 13' (FIG. 5) are positioned on both sides of the threaded shaft 11 and include sliding members 14, 14' supporting the plate 9 and tray 3.

METHOD OF OPERATION

Referring now to FIGS. 4A–4D, the different steps of winding and doffing in accordance with the present invention are illustrated. As shown in FIG. 4A, one end of the winding roller R is pivotably supported on the support arm 1 by the universal coupling 2. The small diameter stub shaft portion R' of the other end of the roller R is fitted in and supported at the notched section of the other support arm 1'.

Figure 4B:
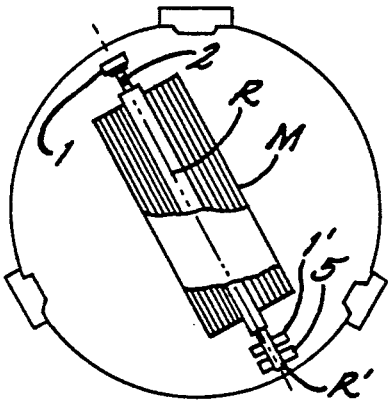

When a predetermined length of knitted cloth has been wound, a termination signal is generated and the winding roller R stops at a predetermined position as shown in FIG. 4B. After the winding roller has stopped, a conventional cutter cuts the roll of knitted cloth M from the descending knitted cloth produced on the knitting machine.

Figure 4C:
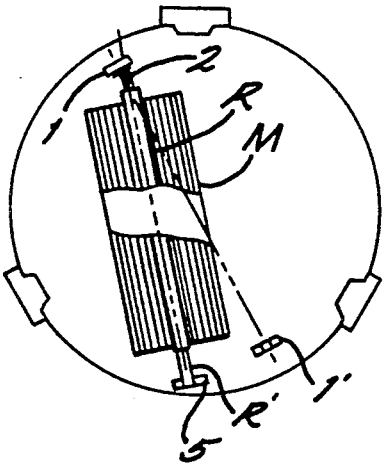
Figure 4D:
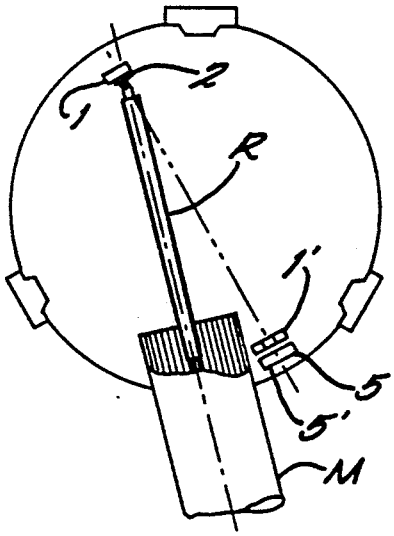

After cutting, the roll of knitted cloth M is transferred to the unloading, doffing position in an inclined state as shown in FIGS. 3 and 4C. The small diameter stub shaft portion R' of the winding roller R is disengaged from the support arm 1', placing the winding roller R in the inclined state. As will be described later, the universal joint 2 is used as a fulcrum to aid in pivoting the winding roller R into the unloading, doffing position, where the knit roll M is pushed out from the winding roller R and unloaded from the knitting machine as shown in FIG. 4D. After unloading of the roll of knitted cloth, the emptied winding roller R is returned to the home position (FIG. 4A).

Referring now to FIG. 2, there is illustrated in greater detail the mechanism for transferring the roll of knitted cloth M to the unloading, doffing position. After winding the roll of knitted cloth M, a knitting termination signal is generated for stopping rotation of the winding roller R. At this time the knitted cloth M is cut. The leg 5 is moved counterclockwise and the winding roller R is pivotably moved so that the end of the cloth roll M is placed on the receiver tray 3 as shown in the dotted lines of FIG. 2. As the leg 5 is pivoted to cause the small diameter stub shaft portion R' of the winding roller R is disengaged from the support means 5' on the upper end of the leg 5.

Referring now to FIG. 3, there is illustrated in greater detail the mechanism for unloading the rolled knitted cloth M. The receiver tray 3 on which the roll of knitted cloth M is placed after transfer is slid in an unloading direction (from left to right) by actuating the motor 10 for driving the threaded shaft 11. The pushing plate member 4 engages the end of the roll of knitted cloth M, pushing the roll of knitted cloth M from the winding roller R. After the roll of knitted cloth M is removed, as illustrated in dash-dot lines in the right-hand portion of FIG. 3, the empty winding roller R is supported at its end on the upper end of the receiving member 8. The motor 10 is reversed and the receiver tray 3 is returned to its initial home position.

As the receiver tray 3 returns to the home position, sliding members, in the form of a cloth pushing piston 15, (FIG. 5) may be used to exert a pushing force onto the side of the cloth roll M positioned on the receiver tray 3. The receiver tray 3 is emptied by pushing the roll of knitted cloth M from the receiver tray 3, thus completing the unloading process.

The present invention is advantageous over other prior art proposals because the knitted cloth is wound on a single winding roller, and after winding to a predetermined length, the roll of knitted cloth M is cut and transferred to the unloading position where the roll is removed from the winding roller and then unloaded from the knitting machine.

The winding and doffing apparatus has advantages also over other winding and doffing apparatus using the multiple number of cloth winding rollers on the split-type winding roller as described before. The winding and doffing apparatus of the present invention can be installed without changing installation positions of existing knitting machines. Furthermore, the apparatus of the present invention is simple in structure, precise in operation, and improved in performance.

Although only one embodiment of the invention has been disclosed and described, it is apparent that other embodiments and modifications of the invention are possible.

What is claimed is:

1. An apparatus for winding and doffing knitted cloth in a circular knitting machine, comprising opposed winding apparatus support arms, a winding roller for winding knitted cloth, said winding roller having two opposed ends, means pivotably connecting one end of said winding roller to one of said support arms, means removably supporting the other end of said winding roller on the other of said support arms so that said other end of said winding roller may be moved from a home, winding position to an unloading, doffing position where said other end of said winding roller is removed from said other of said support arms and the winding roller and roll of knitted cloth is positioned in a downward, inclined direction, and unloading means for unloading and doffing the knitted roll from said winding roller comprising, a receiver tray dimensioned for receiving the doffed roll of knitted cloth, said receiver tray being positioned adjacent said support arms for engaging the knitted roll when moved into the doffing position, and means for pushing the roll of knitted cloth from said winding roller and onto said receiver tray.

2. An apparatus according to claim 1 wherein said means pivotably connecting said one end of said winding roller to said one support arm comprises a universal joint.

3. An apparatus according to claim 1 wherein said winding roller is tapered from a larger to a smaller diameter in a direction toward the removably supported other end.

4. An apparatus according to claim 1, including transfer means for moving said other end of said winding roller from the home position to the unloading position, said transfer means comprising a vertical leg member having upper and lower ends, pivot means supporting the lower end of said leg member, and support means on the upper end of said leg member for engaging and supporting said other end of said winding roller so that pivotal movement of said leg member moves the end of the roll of knitted cloth adjacent said other end of said winding roller to the unloading position on said receiver tray.

5. An apparatus according to claim 1, wherein said unloading means comprises a pair of rollers provided under said receiver tray for rolling on the floor, a pushing plate member facing a side of the accumulated roll of knitted cloth for pushing an end of the roll of knitted cloth, a winding roller receiver member on which the free end of the winding roller is placed temporarily in the unloading, doffing position, a threaded shaft operatively connected to said receiver tray for allowing reciprocative sliding movement of said receiver tray when said threaded shaft is rotated, and means for rotating said threaded shaft.

6. An apparatus according to claim 5 wherein said means for rotating said threaded shaft comprises a reversible motor.

7. A method of winding and doffing a roll of knitted cloth in a circular knitting machine, comprising the steps of winding a roll of knitted cloth around a winding roller pivotably connected at one end by a universal joint to a support arm of the knitting machine, stopping the winding roller at a predetermined position, cutting the roll of knitted cloth to separate it from the descending knitted cloth, transferring the other end of the winding roller and the roll of knitted cloth to an unloading position by swinging the other end of the winding roller and the other end of the roll of knitted cloth onto a receiver tray using the universal joint as a fulcrum, pushing the roll of knitting cloth longitudinally to remove the roll of knitted cloth from the winding roller and onto the receiver tray, and returning the winding roller to its home position.

* * * * *